US009802424B2

(12) United States Patent
Sonnauer

(10) Patent No.: US 9,802,424 B2
(45) Date of Patent: Oct. 31, 2017

(54) METHOD AND DEVICE FOR INKJET PRINTING ON CONTAINERS

(71) Applicant: KRONES AG, Neutraubling (DE)

(72) Inventor: Andreas Sonnauer, Woerth (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 14/924,378

(22) Filed: Oct. 27, 2015

(65) Prior Publication Data

US 2016/0136965 A1 May 19, 2016

(30) Foreign Application Priority Data

Nov. 18, 2014 (DE) ..... 10 2014 223 523

(51) Int. Cl.
*B41J 3/407* (2006.01)
*B41J 2/01* (2006.01)
*B41J 2/21* (2006.01)

(52) U.S. Cl.
CPC ..... *B41J 3/4073* (2013.01); *B41J 2/01* (2013.01); *B41J 2/2132* (2013.01)

(58) Field of Classification Search
CPC ..... B41J 3/4073; B41J 2/01; B41J 2/2132
See application file for complete search history.

(56) References Cited

U.S. PATENT DOCUMENTS

2004/0252152 A1 12/2004 Vilanova et al.
2004/0252174 A1* 12/2004 Baxter ..... B41J 3/4073 347/101
2009/0205516 A1* 8/2009 Till ..... B41F 17/18 101/39
2010/0182367 A1* 7/2010 Takagi ..... B41J 2/145 347/14
2011/0012949 A1 1/2011 Enge
2011/0261099 A1 10/2011 Miyashita et al.
(Continued)

FOREIGN PATENT DOCUMENTS

CN 101523416 A 9/2009
CN 102241189 A 11/2011
(Continued)

OTHER PUBLICATIONS

European Search Report, European application No. EP 15 18 9475, dated Mar. 23, 2016.
(Continued)

*Primary Examiner* — Geoffrey Mruk
*Assistant Examiner* — Scott A Richmond
(74) *Attorney, Agent, or Firm* — Marshall, Gerstein & Borun LLP

(57) ABSTRACT

In a method and a device for inkjet printing on containers, at least a first and a second subprint complementing each other in the printing direction so as to form a print image are joined. The first subprint is printed starting from a connection area or up to a connection area. Subsequently, the second subprint is printed with a feed towards the connection area such that the first and second subprints interleavingly overlap in the connection area. This allows a joining of subprints with unobtrusive transitions even in the case of dimensional tolerances and complicated cross-sections of the respective container.

16 Claims, 3 Drawing Sheets

(56) References Cited

U.S. PATENT DOCUMENTS

| | | | | |
|---|---|---|---|---|
| 2013/0222452 | A1* | 8/2013 | Gullentops | B41C 1/003 347/9 |
| 2014/0028771 | A1* | 1/2014 | Yamada | B41J 2/0057 347/104 |
| 2014/0368841 | A1* | 12/2014 | Ojima | B41F 17/20 358/1.4 |
| 2014/0374016 | A1 | 12/2014 | Schach | |
| 2015/0298467 | A1* | 10/2015 | Cofler | B41J 3/4073 347/16 |

FOREIGN PATENT DOCUMENTS

| | | | |
|---|---|---|---|
| CN | 103946115 | A | 7/2014 |
| CN | 104002562 | A | 8/2014 |
| CN | 104118214 | A | 10/2014 |
| DE | 3526769 | A1 | 1/1987 |
| DE | 102011113150 | A1 | 3/2013 |
| DE | 102012005046 | A1 | 9/2013 |
| EP | 0619188 | A2 | 10/1994 |
| EP | 2208541 | A2 | 7/2010 |
| EP | 2669088 | A1 | 12/2013 |
| EP | 2769848 | A2 | 8/2014 |
| WO | WO-2008/040968 | A1 | 4/2008 |
| WO | WO-2012/147695 | A1 | 11/2012 |

OTHER PUBLICATIONS

German Search Report for Application No. 102014223523.5, dated Aug. 3, 2015.
English Translation of First Chinese Office Action for Application No. 201510794907.4, dated Sep. 29, 2016.

* cited by examiner

METHOD AND DEVICE FOR INKJET PRINTING ON CONTAINERS

CROSS-REFERENCE TO RELATED APPLICATION

The present application claims priority to German Patent Application No. 102014223523.5, filed Nov. 18, 2014. The priority application, DE102014223523.5, is hereby incorporated by reference.

The present invention relates to method and a device for inkjet printing on containers.

BACKGROUND

For inkjet printing on containers, such as beverage bottles or the like, e.g. EP 2 669 088 A1 and DE 10 2011 113 150 A1 disclose that containers to be printed on are guided along circular conveying paths past stationary printing stations or that printing stations circulate together with containers on carousels or the like. Due to a rotation of the containers about their own axis, a feed of the container sidewalls to be printed on is then caused in front of the respective activated print heads.

The print heads used for this purpose normally have nozzle rows extending transversely to the printing direction. Depending on the respective structural design, individual ones of these print heads may perhaps not cover the whole width of a print image as defined in a direction transversely to the printing direction. In this case, print heads will be used, whose print areas abut on one another or overlap one another in a direction transversely to the printing direction. Depending on the accuracy of alignment of print areas adjoining one another in this way, visible transitions impairing the print image will occur between the thus produced subprints, said transitions occurring e.g. at locations that have been printed on twice or at connection gaps in the print image.

In order to counteract these problems, e.g. US 2004/0252152 A1 and US 2011/0012949 A1 disclose that subprints abutting on one another in a direction transversely to the printing direction are provided in an overlapping mode, and that the transition areas are configured to interleave with one another so as to disguise double-print areas and connection gaps. The demands on the highest possible degree of precision in the alignment of neighboring print heads can thus be reduced, in particular since the relative position of the print heads and containers transversely to the printing direction can normally be observed in a reproducible manner and does not change during the printing process.

A still existing problem is, however, that, when containers are to be printed on directly, it will be necessary to print on a plurality of components of a color model over a predetermined circumferential area of the containers, and perhaps even over the full circumference thereof, making use of different print heads. In addition, due to the machine performance demanded in beverage filling plants and due to the resultant conveying speeds, it is often such that only circumferential subareas of the container surface to be printed on can be positioned in front of a specific row of nozzles and printed on continuously without any interruptions. It follows that, in many cases, subprints have to be joined together also in the direction of printing so as to produce on the containers a continuous print image in said direction of printing.

The above situation becomes more difficult due to dimensional tolerances, which, depending on the actual cross-section of the container, have the effect that the sidewall to be printed on will vary in length in the circumferential direction. Depending on the dimensional tolerances and the size of the print image extending along the circumference, the problem of an unsatisfactory quality of connection areas between subprints arises especially in the direction of printing, said unsatisfactory quality being caused by overlapping double-print areas and/or by connection gaps.

Hence, there is a need for methods and devices for inkjet printing on containers, by means of which at least one of the above-mentioned problems can be eliminated or rendered less serious.

SUMMARY OF THE DISCLOSURE

The posed task is solved by a method suitable for inkjet printing on containers, at least a first and a second subprint, which complement each other in the printing direction, being joined so as to form a print image. According to the present invention, the first subprint is printed first starting from a connection area or up to a connection area. Subsequently, the second subprint is printed with a feed towards the connection area such that the first and second subprints interleavingly overlap in the connection area.

In particular for printing directly onto curved surfaces of containers, whose length to be printed on may vary due to dimensional tolerances of the containers, subprints can be joined through a transition area that will attract less attention on the part of an observer than transition areas produced by conventional methods. The term "interleaving" means here that the subprints do not adjoin one another in the connection area along a straight line extending transversely to the printing direction, but that an intermeshing and/or mosaic-like interengaging connection area is formed, in which image contents of the first as well as of the second subprint are distributed such that the transition between the image areas becomes indistinct to the observer's eye.

Thus, a linear double print or a linear gap between adjoining subprints can be avoided or at least be configured such that it will not attract the observer's attention. The interleaving print will, in addition, reduce the demands on the dimensional accuracy of the containers and the accuracy of print head positioning and/or rotary positioning of the containers relative to at least one print head used for inkjet printing.

Preferably, the printing direction runs laterally about a main axis of the containers. Hence, the method according to the present invention is particularly suitable for joining subprints that cover circumferential subareas of the containers. The circumferential subareas of the containers can thus be printed on with a demanded print quality, in particular while the container is being conveyed. In addition, dimensional tolerances, especially those concerning the circumference of the container, can be compensated.

According to a preferred embodiment, the connection area covers a circumferential arc segment whose length comprises, related to the print resolution of the print image, 5 to 50 pixels, in particular 10 to 30 pixels. It is also imaginable that the circumferential arc segment has an absolutely defined length of 0.1 to 1 mm, or in particular 0.2 to 0.5 mm. The circumferential arc segment is to be understood as a portion of the outer cross-section of the container. The connection area thus defines an overlap area with the above defined length, in which the subprints interleavingly overlap in a circumferential direction. Visually obtrusive double prints or gaps in the print image can thus be avoided in a sufficiently reliable manner in the case of the dimensional tolerances which especially plastic containers normally exhibit.

According to a preferred embodiment, the containers are printed on over a print area of at least 362°, in particular of at least 365°, at least when they are printed on over their full circumference. The full circumference of the containers can thus easily be printed on. The use of only one print head for each printing ink will then suffice.

Preferably, the containers are rotated about their own axis in front of at least one print head. This allows a feed of container surfaces, and in particular of curved container surfaces, in front of the print head. A rotation of the containers about their own axis can nevertheless be combined with a print feed of the containers in front of the print head caused by a conveyor means. Especially when the container walls to be printed on have an infinite or a very large radius of curvature, a suitable feed in front of the print head may also be produced exclusively by a conveying movement of the containers relative to the print head.

According to a preferred embodiment, the first and second subprints are printed by means of different print heads. The print image can thus be composed of a plurality of subprints complementing each other in a circumferential direction in a visually appealing fashion. This will especially be of advantage, if a full-circumference rotation of the container in front of an individual print head should not be possible for lack of time while the container is being conveyed and/or if non-rotationally symmetric cross-sections of the container necessitate the use of different print heads for printing on circumferential subareas of the container.

Preferably, the end of the second subprint adjoins the beginning of the first subprint. The beginning and the end of the subprints should here be understood in the sense of a time sequence during the container printing process. For example, the first subprint may smoothly merge with the second subprint in the printing direction, e.g. in the case of a full-circumference rotation of the container about its own axis in front of a single print head. The beginning of the printing operation will then define the beginning of the first subprint. The end of the second subprint will then occur, by definition, when the beginning of the first subprint is reached after a full-circumference rotation.

Since the circumference of the container to be printed on may vary due to dimensional tolerances, the joining according to the present invention at the beginning of the first subprint and at the end of the second subprint allows to obtain a print image presenting itself to the observer as a continuous image having neither gaps nor double print areas.

Preferably, at least two connection areas distributed around the respective container in a circumferential direction are produced simultaneously for each container. To this end, at least two print heads distributed around the container in a circumferential direction are provided, said print heads ejecting ink in temporally overlapping printing processes while the container is being rotated. Thus, e.g. a rotary movement taking place over only part of the circumference of the containers will suffice for producing a full-circumference print image with subprints joined to one another in accordance with the present invention. Direct printing can thus be carried out more rapidly and/or with a plurality of components of a color model.

According to a preferred embodiment, at least two components of a color model are printed one on top of the other such that connection areas of different components are displaced relative to one another in the printing direction. This means that e.g. a connection area between two subprints of a component is located in a circumferential subarea of the print image other than the circumferential subarea in which a connection area of some other component of the color model is located. This allows overlap areas between the subprints in the whole print image to be configured in a particularly unobtrusive fashion. For example, artifacts caused by interleaving printing would then not overlap in the same circumferential area of the print image, but would be distributed to different circumferential areas of the print image for the individual components of the color model.

Preferably, image contents of a digital master copy, which are comprised in the first and/or second subprint, are distributed by means of an image processing algorithm to pixel patterns complementing one another in the connection area so as to form a print image. The term pixel patterns refers here e.g. to binary masks complementing one another in the connection area so as to form a print image. Preferably, a continuous boundary line is not defined between the masks of the first and second subprints. The connection area can thus be rendered unobtrusive to the observer's eye. Image contents of the first subprint can here be transferred to the second subprint and vice versa. Likewise, image contents can be distributed to the first and second subprints in a suitable manner, depending on the respective print image. In this connection, it is also possible to reproduce image contents both in the first and in the second subprint by means of copy and paste.

Pixels often consist of differently sized droplets and associated inks. Depending on the control and on the processing of the master copy, the print heads are capable of printing different droplet sizes.

Alternatively or additionally to the above described printing, each pixel may be printed in the transition area in two printing processes. The necessary ink quantity or droplet size can then be distributed to two print heads. For example, one pixel may be composed of a total of seven subdroplets, a subdroplet being here the respective smallest representable droplet. In the transition area, e.g. one print head may eject four subdroplets and the other print head the other three subdroplets of the pixel.

Preferably, at least a third and a fourth subprint are joined to the first and second subprints in a direction transversely to the printing direction such that the respective adjacent subprints interleavingly overlap in the associated connection areas. The print image can thus be composed of individual interleaving subprints that are added to one another like tiles.

Subprints adjoining one another in a circumferential direction of the containers can thus be joined in a visually unobtrusive manner, and subprints, which are joined to one another in an axial direction so as to increase the print width, can thus be combined in an optically attractive fashion.

Preferably, the containers are specially shaped bottles. In particular when specially shaped bottles are rotated about their own axis, changes in the printing distance and the print resolution resulting from the print feed will occur. By defining individual subprints, which can advantageously be printed in front of a print head, and by interleavingly joining these subprints, a print image presenting itself to the observer's eye without any gaps and transitions can be produced in spite of cross-sections that are not rotationally symmetric.

Preferably, the specially shaped bottles have a curved cross-section in a sidewall portion to be printed on, in particular a curved cross-section with a varying radius of curvature. In these areas it is particularly difficult to produce, by means of a single print head, a circumferentially continuous direct print having the demanded quality. Depending on the change in the radius of curvature, suitable circumferential subareas can therefore be joined interleavingly in the printing direction.

The posed task is also solved by a device according to claim 14. According to said claim, this device serves to execute the method according to at least one of the above described embodiments and comprises at least one print head, at least one rotatable support for a container, and a control unit for controlling the print head and the support such that, in the connection area according to the present invention, the first and second subprints can be printed onto the container in an interleaving fashion.

Preferably, the device will then comprise at least two print heads, which are displaced relative to one another in the printing direction and which are coordinated such that they can be used for composing a print image from subprints that interleave in the printing direction.

BRIEF DESCRIPTION OF THE SEVERAL VIEWS OF THE DRAWING

Preferred embodiments of the present invention are shown in the drawing, in which:

FIG. 1 exemplarily illustrates the fundamental problem to be solved when a first and a second subprint 1, 2 are joined in the printing direction 3 so as to form a continuous print image 4. The respective subprints 1, 2 are to be produced successively from a starting area 1*a*, 2*a* to an end area 1*b*, 2*b* such that image contents 1*c*, 2*c* of the first and second subprints 1, 2 will abut on one another on an imaginary target butt line 5 extending transversely to the printing direction 3 and smoothly complement each another in the print image 4.

FIG. 1 additionally shows a first and a second print head 6, 7 by means of which the subprints 1, 2 are printed e.g. onto a sidewall 8*a* of a container 8. The print heads 6, 7 have provided thereon rows of nozzles 6*a*, 7*a* (schematically indicated) extending transversely to the printing direction 3. Depending e.g. on the structural design of the print heads 6, 7, said rows of nozzles 6*a*, 7*a* are spaced apart at a distance 9 in the printing direction 3.

Figure 2:
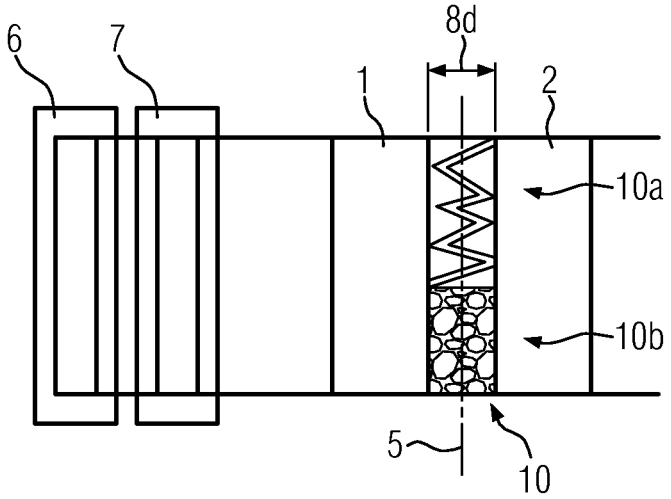
FIG. 2 shows an example of an interleaving connection area in accordance with the present invention.

As can additionally be seen from FIG. 3, the distance 9 between the print heads 6, 7 may also result from the fact that the latter face different circumferential subareas 8*b*, 8*c* of the container 8, displaced e.g. by 180° in a circumferential direction, so as to produce the subprints 1, 2 in a temporally overlapping or simultaneous mode by means of the print heads 6, 7 while the container 8 is rotating about its own axis. A suitable rotation in the printing direction 3 about the main axis 8' of the container 8 is schematically indicated in FIG. 2.

Irrespectively of the size of the respective distance 9 between individual rows of nozzles 6*a*, 7*a*, the subprints 1, 2 have to be joined in the printing direction 3 so as to form the print image 4, as far as possible without connection gaps and/or double-print areas that are visible during normal use of the container 8.

Due to dimensional tolerances and/or shape tolerances existing e.g. in the case of the circumference of the whole sidewall 8*a* to be printed on and/or in the case of individual circumferential subareas 8*b*, 8*c*, the actual length (defined here in the circumferential direction) of the whole printing area to be covered and/or the actual distances between the subprints 1, 2 to be joined in the printing direction 3 may vary.

Figure 1:
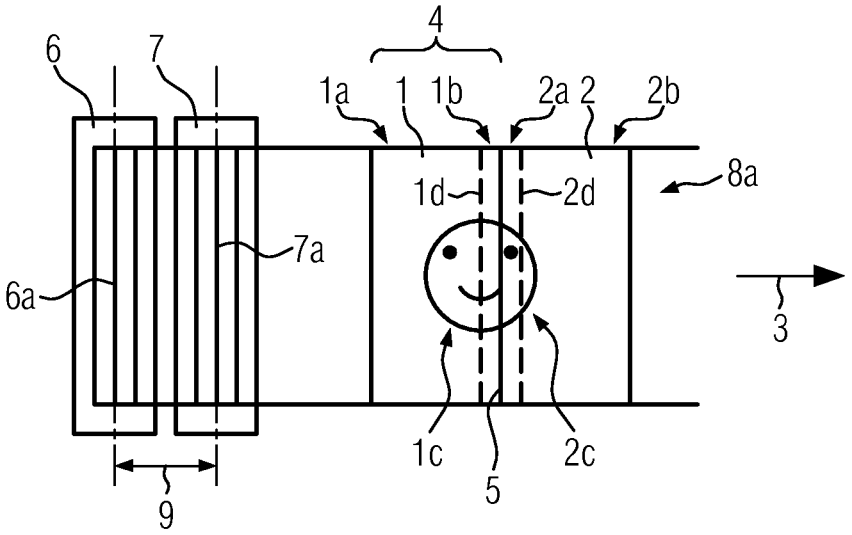
FIG. 1 shows an example of two subprints which are to be sequentially joined so as to form a print image in a conventional manner.

Contrary to the idealized representation according to FIG. 1, the subprints 1, 2 will then not smoothly follow one after the other along the imaginary target butt line 5. Instead, connection gaps which are not printed on, or an overlapping double print with subprint image contents 1*c*, 2*c* printed one on top of the other, form e.g. between the end area 1*b* and the starting area 2*a* of the subprints 1, 2. Such boundaries 1*d*, 2*d* of the subprints 1, 2 which, erroneously, are not located on the target butt line 5 are exemplarily indicated by a broken line in FIG. 1. The resultant quality losses occurring when the sidewall 8*a* is directly printed on are counteracted by the interleaving overlap of the first and second subprints 1, 2 explained hereinbelow.

To this end, image contents 1*c* of the end area 1*b* of the first subprint 1 and image contents 2*c* of the starting area 2*a* of the second subprint 2 are interleavingly distributed within a connection area 10. This is schematically shown in FIG. 2.

Preferably, the connection area 10 according to the present invention covers in the printing direction 3 a circumferential arcuate segment 8*d* of the sidewall 8*a*, which, related e.g. to the print resolution of the print image 4, has a length of 5 to 50 pixels, in particular of 10 to 30 pixels, or an absolutely defined length of 0.1 to 1 mm, or in particular 0.2 to 0.5 mm. It follows that, in contrast to the conventional, ideally non-overlapping abutting contact of the subareas 1, 2 along the imaginary continuous target butt line 5, an overlap area extending in the printing direction is obtained.

The term "interleaving" is to be understood such that the image contents 1*c*, 2*c* are intermeshed, cf. the upper pattern example 10*a* in the connection area 10, and/or that pixels of the image contents 1*c*, 2*c* are distributed in the connection area 10 in a mosaic-like fashion, cf. the lower pattern example 10*b*. Making use of image processing algorithms, pixels of the image contents 1*c*, 2*c* can flexibly be distributed in the connection area 10, depending on the print image 4 to be produced. This has the effect that conventional continuous straight boundaries 1*d*, 2*d* of the subprints 1, 2 are broken through at least in certain sections thereof.

Alternatively or additionally, image contents 1*c*, 2*c* in the connection area 10 may be printed in two printing processes. The amount of ink per pixel or fractions of the droplet size of the pixel can then be distributed to the print heads 6, 7. For example, a pixel may be composed of a plurality of subdroplets, a subdroplet being here the respective smallest representable droplet. In a transition area, e.g. one print head 6 may eject a suitable number of subdroplets and the other print head 7 may eject the rest of the subdroplets of the respective pixel.

For example, pixels of the first subprint 1 are, in the connection area 10, displaced relative to the boundary 1*d* in the printing direction 3 and/or copied and pasted, and pixels of the second subprint 2 are, in the connection area 10, displaced relative to the boundary 2*d* in a direction opposite to the printing direction 3 and/or copied and pasted. To put it simply, the connection area 10 according to the present invention differs from the prior art especially insofar as the image contents 1*c*, 2*c* do not end in an abrupt fashion at boundaries 1*d*, 2*d* extending transversely to the printing direction 3. Said boundaries 1*d*, 2*d* may be straight and orthogonal to the printing direction 3, jagged, oblique or the like.

By means of image processing of the image contents 1*c*, 2*c*, the length of the connection area 10 in the printing direction 3, i.e. for example the length of the arcuate segment 8*d*, can flexibly be adapted to the dimensional tolerance and/or shape tolerance of the sidewall 8*a* to be expected and/or the print image 4 to be printed.

Figure 3B:
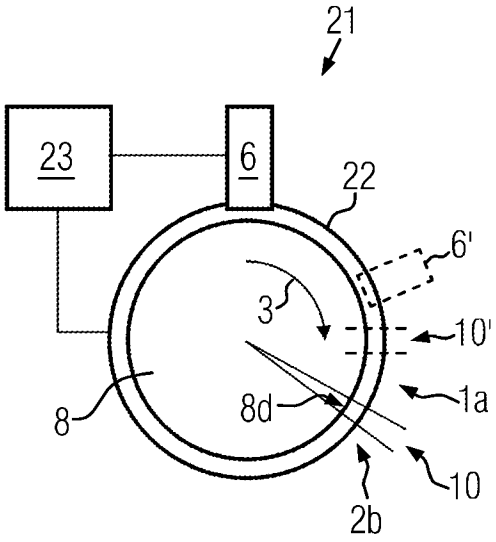
FIG. 3*b* shows a schematic top view of an alternate device of the present invention.
Figure 3A:
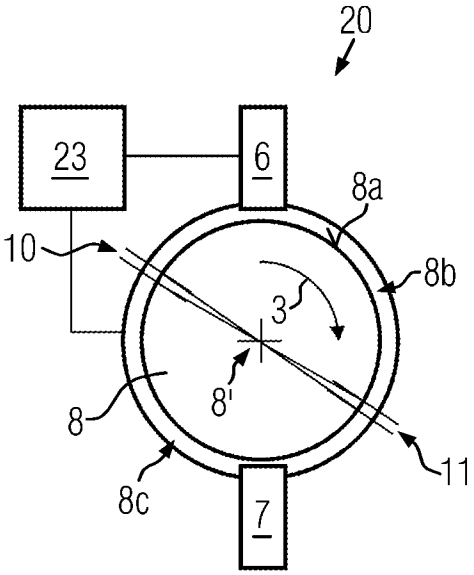
FIG. 3*a* shows a schematic top view of a first device according to the present invention.

FIGS. 3*a* and 3*b* show schematic top views of preferred embodiments 20, 21 of a device according to the present invention differing from one another with respect to the number of print heads.

On the left hand side of each of FIGS. 3*a* and 3*b*, a container 8 to be printed on and two 180° spaced-apart print heads 6, 7 distributed around the circumference of the container are shown. A print feed of the container sidewall 8*a* in the printing direction 3 with respect to the print heads 6, 7 is created through a rotation of the container 8 about its own axis in front of both print heads 6, 7 at the same time. In the examples according to FIGS. 3*a* and 3*b*, the first subprint 1 may be produced by means of one of the print heads 6 and the second subprint 2 by means of the other print head 7. In this way, two connection areas 10, 11 according to the present invention are obtained, which are produced substantially simultaneously and which interleavingly overlap in accordance with the present invention in the sense of FIG. 2. This will also be possible in the case of a deviating number of and/or circumferential distribution of the print head positions.

On the right hand side of each of FIGS. 3*a* and 3*b*, it is schematically indicated how the container 8 is printed on over its full circumference by means of only one print head 6. In this case, the connection area 10 will only be obtained when the container 8 has been rotated by more than 360°, e.g. by 362°. The starting area 1*a* of the first subprint 1 is here produced first and the end area 2*b* of the second subprint 2 is added to said starting area 1*a* in the way disclosed in the present invention, without interrupting the print feed.

However, connection areas 10 according to the present invention can, in principle, be produced by means of arbitrary rotary movements of the container 8 about its own axis, and also by rotary movements taking place over only part of the circumference of the container 8. To this end, e.g. a rotatable support 22 for the container 8 and a control unit 23 for controlling the print head 6 and the support 22 are provided.

Likewise, print heads 6, 6' for different components of a color model, such as CMYK, can be controlled separately in this way, so as to create associated connection areas 10, 10' such that they are displaced relative to one another in a circumferential direction. This is exemplarily indicated in each of FIGS. 3*a* and 3*b* by a broken line.

The first and second subprints 1, 2 are defined with respect to the connection area 10, 11 to be created, irrespectively of the number of print heads 6, 7 used and irrespectively of whether the print feed in the printing direction 3 is interrupted between individual subprints 1, 2. For clearer understanding, the beginning and the end of the subprints 1, 2 are related to the printing direction 3. Whether the printing direction 3 is reversed for individual subprints 1, 2 is, however, irrelevant for the present invention. What matters is that printing is effected towards a starting area or an end area of a previously produced subprint and that the respective connection area 10, 11 is configured in an interleaving fashion.

Figure 4:
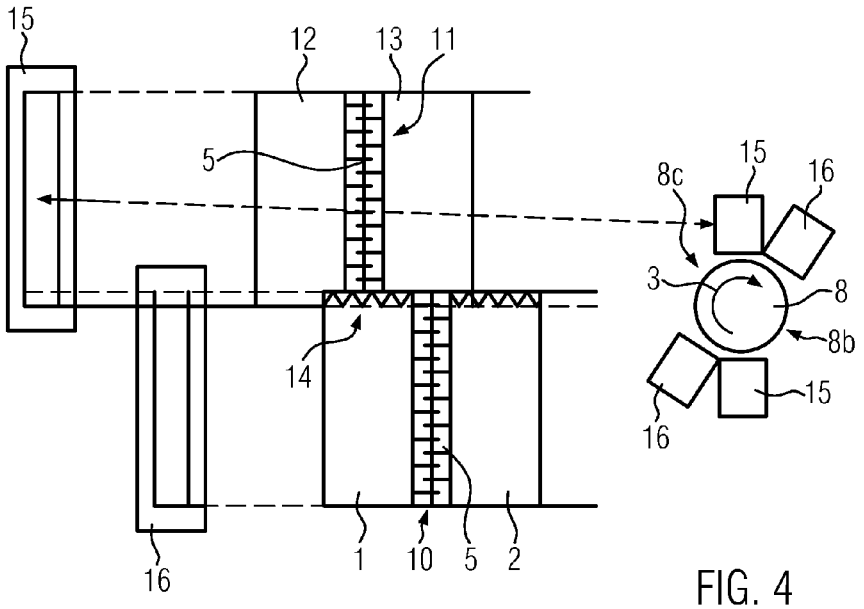
FIG. 4 shows an example of connection areas interleaving in the printing direction and transversely to the printing direction.

FIG. 4 shows another advantageous variant in the case of which connection areas 10, 11 according to the present invention are produced between first and second subprints 1, 2 and between third and fourth subprints 12, 13 in the printing direction 3. In addition, the subprints 1, 2, 12, 13 share a connection area 14 in a direction transversely to the printing direction 3. This can be accomplished e.g. by means of print heads 15, 16 which are displaced relative to one another along the printing direction 3 as well as transversely to the printing direction 3. Also the connection area 14 is then formed with subprints 1, 2, 12, 13 interleaving in a direction transversely to the printing direction 3.

On the right hand side of FIG. 4 it is additionally outlined that subprints 1, 2, 12, 13, which interleave in the printing direction 3 and in a direction transversely to the printing direction 3, can, analogously to FIG. 3, be produced on different circumferential subareas 8*b*, 8*c* also by means of a plurality of suitably distributed print heads 15, 16 simultaneously or in a temporally overlapping mode.

Figure 5:
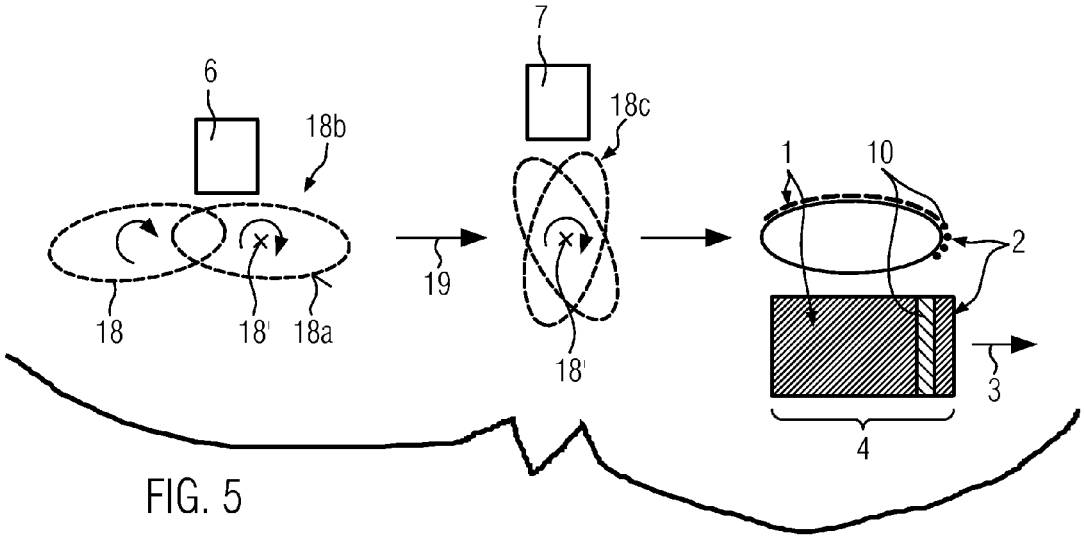
FIG. 5 shows an example of printing on a specially shaped bottle with a connection area according to the present invention.

FIG. 5 shows another advantageous variant of printing on containers 18, which are configured as specially shaped bottles and which have an non-rotationally symmetric cross-section. By way of example, an elliptical cross-section to be printed on is outlined. Due to the substantial deviation in the radii of curvature of individual circumferential subareas 18*b*, 18*c* of the sidewall 18*a* during the rotation of the container 18 about its main axis 18', the print image 4 must be composed of a plurality of subprints 1, 2 in the printing direction 3.

In FIG. 5, the circumferential subareas 18*b*, 18*c* have exemplarily associated therewith the first and second subprints 1, 2, which share a connection area 10 according to the present invention in an interleaving fashion. The connection area 10 is identified by oblique hatches.

The circumferential subareas 18*b*, 18*c* of the sidewall 18*a* are, for this purpose, successively printed on from print heads 6, 7 arranged at suitable distances from the main axis 18', while the container 18 is rotating about its own axis. The containers are then additionally moved along a linear and/or circular conveying path 19 or along a conveying path 19 having some other shape, so as to create a suitable print feed in front of the print heads 6, 7.

The above described embodiments and variants can be combined in a flexible manner so that different containers 8, 18, such as bottles having a rotationally symmetric cross-section or specially shaped bottles, can be printed on directly by means of an inkjet.

What is claimed is:

1. A method for inkjet printing on containers, comprising the steps of joining at least a first and a second subprint complementing each other in the printing direction so as to form a print image, wherein the first subprint is printed first starting from a connection area or up to a connection area and the second subprint is printed subsequently with a feed towards the connection area such that the first and second subprints interleavingly overlap in the connection area, wherein the first and second subprint do not adjoin one another in the connection area along a straight line extending transversely to the printing direction, but the connection area is formed in an intermeshing manner distributing image contents of the first and second subprint in a gear tooth configuration, and wherein the printing direction runs laterally about a main axis of the containers, and the first and second subprint interleavingly overlap in a circumferential direction of the containers.

2. The method according to claim 1, wherein the connection area covers a circumferential arc segment whose length comprises 5 to 50 pixels of the print image.

3. The method according to claim 1, wherein the containers are printed on one of at least over their full circumference, over a print area of at least 362°, or over a print area of at least 365°.

4. The method according to claim 1, wherein the containers are rotated about their own axis in front of at least one print head.

5. The method according to claim 1, wherein an end area of the second subprint adjoins a starting area of the first subprint.

6. The method according to claim 1, wherein, for each container, at least two connection areas distributed around the container in a circumferential direction are produced simultaneously.

7. The method according to claim 1, wherein at least two components of a color model are printed one on top of the other such that connection areas of different components are displaced relative to one another in the printing direction.

8. The method according to claim 1, wherein image contents of a digital master copy comprised in the first and/or second subprint are distributed by means of an image processing algorithm to pixel patterns complementing one another in the connection area so as to form a print image.

9. The method according to claim 1, wherein, in addition, at least a third and a fourth subprint are joined to the first and second subprints in a direction transversely to the printing direction such that the respective adjacent subprints interleavingly overlap in the associated connection areas.

10. The method according to claim 1, wherein the containers (18) are specially shaped bottles.

11. The method according to claim 10, wherein the specially shaped bottles have a curved cross-section in at least one circumferential subarea of their sidewall to be printed on.

12. The method according to claim 11, wherein the curved cross-section has a varying radius of curvature.

13. A device for executing the method according to claim 1, comprising at least one print head, at least one rotatable support for a container, and a control unit for controlling the print head and the support such that, in the connection area, the first and second subprints can be printed onto the container in an interleaving fashion.

14. The device according to claim 13, comprising at least two print heads, which are displaced relative to one another in the printing direction and which are coordinated such that they can be used for composing a print image from subprints that interleave in the printing direction.

15. The method according to claim 1 wherein the connection area covers a circumferential arc segment whose length comprises 10 to 30 pixels of the print image.

16. A method for inkjet printing on containers, comprising the steps of joining at least a first and a second subprint complementing each other in the printing direction so as to form a print image, wherein the first subprint is printed first starting from a connection area or up to a connection area and the second subprint is printed subsequently with a feed towards the connection area such that the first and second subprints interleavingly overlap in the connection area, wherein the first and second subprint do not adjoin one another in the connection area along a straight line extending transversely to the printing direction, but the connection area is formed in at least one of an intermeshing and a mosaic-like manner distributing image contents of the first and second subprint, wherein the first and second subprint are printed by different print heads, and wherein one print head ejects a suitable number of subdroplets of a pixel in the connection area, and another print head ejects the rest of the subdroplets of the respective pixel.

* * * * *